United States Patent [19]

Baur et al.

[11] Patent Number: 4,896,594

[45] Date of Patent: Jan. 30, 1990

[54] DRAWING INSTALLATION FOR A PRESS

[75] Inventors: Siegfried Baur; Rudi Brandstetter, both of Goeppingen; Gerhard Roos, Ebersbach-Bünwangen, all of Fed. Rep. of Germany

[73] Assignee: L. Schuler GmbH, Geoppingen, Fed. Rep. of Germany

[21] Appl. No.: 125,925

[22] Filed: Nov. 27, 1987

[30] Foreign Application Priority Data

Nov. 28, 1986 [DE] Fed. Rep. of Germany ..... 3640788

[51] Int. Cl.[4] ..... B30B 1/32; B21D 22/00

[52] U.S. Cl. ..... 100/269 R; 100/214; 72/349; 72/351; 91/519

[58] Field of Search ..... 100/110, 111, 214, 226, 100/230, 269 R, 269 B, 270; 72/453.02, 349, 350, 351, 352, 353, 354, 355, 356, 443; 91/519

[56] References Cited

U.S. PATENT DOCUMENTS

| | | | |
|---|---|---|---|
| 2,585,297 | 2/1952 | Beuscher | 91/519 X |
| 2,926,412 | 3/1960 | Stacy et al. | 100/269 R |
| 3,085,530 | 4/1963 | Williamson | 72/351 |
| 3,122,092 | 2/1964 | Sinclair | 100/269 B |
| 3,636,748 | 1/1972 | Hall | 72/349 |
| 3,762,906 | 10/1973 | Dahlman et al. | 100/269 R X |
| 4,470,287 | 9/1984 | Antonov et al. | 72/350 X |
| 4,499,750 | 2/1985 | Gerber et al. . | |
| 4,712,412 | 12/1987 | Roos et al. . | |

FOREIGN PATENT DOCUMENTS

| | | |
|---|---|---|
| 0074421 | 3/1983 | European Pat. Off. . |
| 3505984 | 8/1986 | Fed. Rep. of Germany . |

*Primary Examiner*—Philip R. Coe
*Assistant Examiner*—Stephen F. Gerrity

[57] ABSTRACT

A drawing installation for a press which has to produce the holding force for the counter-holding during the drawing. The drawing ram displaces the sheet metal part and the sheet metal holder against the holding force to be produced by the drawing installation and must additionally overcome the inertia forces which occur as a result of the acceleration of the parts of the drawing installation at the beginning of the deformation of the sheet metal part. In order to avoid the forces which occur thereby impact-like, the piston rod transmitting the holding force is pre-accelerated in the drawing direction prior to the contact of the drawing ram on the sheet metal holder. The piston rod has an operating surface adapted to be acted upon in the drawing direction. The pressure space coordinated to the operating surface is adapted to be connected with a pressure quantity space of a pre-acceleration cylinder and with a reservoir by way of a follow-up control. The control with respect to time of the pre-acceleration cylinder and of the refill from the reservoir takes place in dependence on the movement of the drawing ram, controlled by the press. The drawing installation is utilizable in presses with mechanically driven drawing ram and a sheet metal holder holding the sheet metal part.

8 Claims, 2 Drawing Sheets

MOVEMENT
DEFORMATION STROKE

DRAWING INSTALLATION FOR A PRESS

BACKGROUND AND SUMMARY OF THE INVENTION

The present invention relates to a drawing installation for a press with a mechanically actuated drawing ram and with a sheet metal holder whose holding force acting on the sheet metal member opposite the drawing direction is produced by way of a pressure-medium-actuated piston rod of a pressure cylinder fixed in the press, and in which the piston rod is operatively connected with a pressure piston having an operating surface adapted to be actuated in the drawing direction, and in which a control system is provided operating in dependence on the ram travel.

During the working stroke of the drawing ram of a press, at first the sheet metal member inserted into the work tool is pressed by the drawing ring against the sheet metal holder and thereafter is displaced together with the sheet metal holder opposite the holding force produced by the drawing installation. The sheet metal member held between the sheet metal holder and the drawing ring is deformed on the press table by the drawing die of the work tool half. In addition to the holding force to be produced by the drawing installation, the drawing ram must also overcome the mass inertia forces which become effective at the beginning of the deformation as a result of the acceleration of the movable sheet metal holder and drawing installation masses.

For avoiding the load on the drawing ram which occurs thereby in an impact-like manner, it is known in the drawing installation according to the EP O 074 421 A1 to move the pressure plate carrying several pressure rods for the sheet metal holder by way of a piston rod of a pressure cylinder fixed in the press, which piston rod is adapted to be actuated by a pressure medium. The piston rod is operatively connected with a pressure piston which has an operating surface adapted to be acted upon in the drawing direction. The operating surface is adapted to be acted upon with pressure by way of a control system operating as a function of ram travel so that prior to the contact of the drawing ram on the sheet metal holder, the latter is adapted to be pre-accelerated in the drawing direction. The pressure space coordinated to the operating surface is supplied directly from the pan by way of a motor-pump-aggregate. This aggregate must produce the pressure required for the pre-acceleration against the action of the drawing apparatus. The hydraulic liquid for the main pressures of the drawing, possibly of the blocking of the drawing installation and of the pre-acceleration and the hydraulic liquid for the control are taken from one and the same pan. The movement of the piston rod of the drawing installation is time-controlled during the pre-acceleration phase. The pre-acceleration phase must terminate in time when reaching the maximum deformation movement (lower dead-center point) of the drawing ram.

In contrast thereto, it is the object of the present invention to control the pre-acceleration of the piston rod in the drawing direction by way of a deliberately predetermined (metered) quantity in hydraulic liquid and to control the refill in hydraulic liquid during the further movement of the piston rod in the drawing direction from a reservoir.

The underlying problems are solved according to the present invention in that the pressure space coordinated to the operating surface of the pressure piston is in fluid communication, on the one hand, with the pressure space of a pre-acceleration cylinder consisting of pressure quantity space, pressure space, and a pressure piston separating these spaces from one another, whereby the pressure space is adapted to be actuated with pressure by the control system operating in dependence on ram travel by way of a throttling directional control valve and, on the other, is adapted to be brought into fluid communication with a reservoir for hydraulic liquid at the termination of the pre-acceleration of the pressure piston by way of a follow-up control operating as a function of ram travel.

The relative movement between the drawing ram and the sheet metal holder during the working stroke of the drawing ram can be controlled toward a value=0 and the contact impact can be completely precluded. As a result thereof, pressure vibrations between the sheet metal member and the sheet metal holder are avoided. The sheet metal member is retained uniformly already at the beginning of the drawing phase.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figures 1, 2:
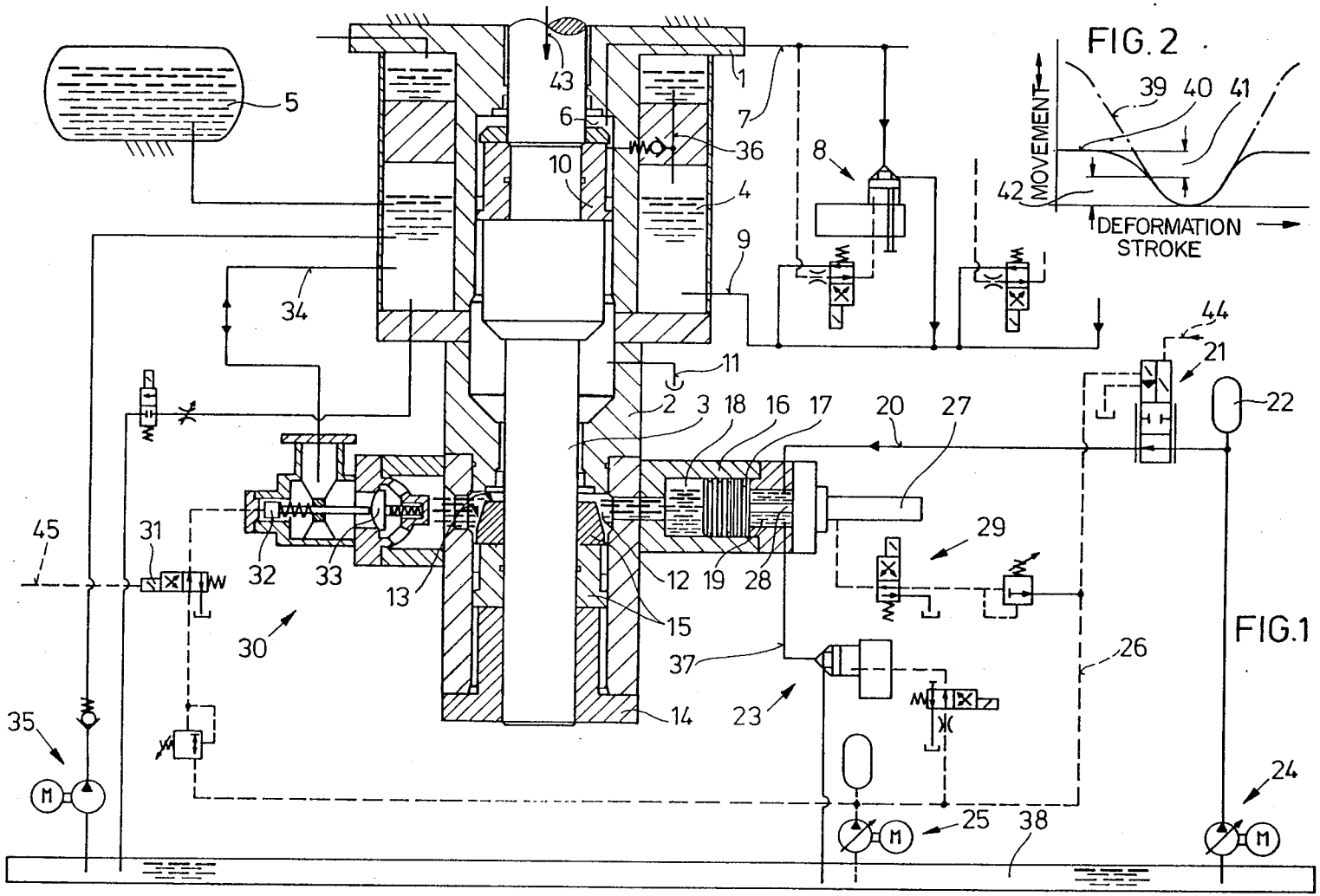
FIG. 1 is a somewhat schematic vertical cross-sectional view through the pre-acceleration area of a drawing installation with the shifting controls for the pre-acceleration in accordance with the present invention.
FIG. 2 is a diagram illustrating the movement of the drawing ram and sheet metal holder during the deformation of a sheet metal part.
Figure 1A:
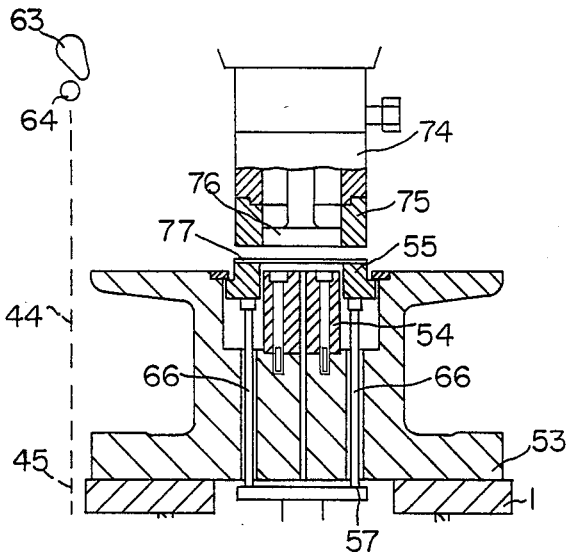
FIG. 1A shows the conventional pressure structure attached to the pressure cylinder of FIG. 1.

Referring now to the drawing, the pressure cylinder 2 in FIG. 1 is secured by way of its cylinder flange 1 in the frame of the press, possibly in the press table. The piston rod 3 adapted to be displaced in and opposite the draw direction 43 is in fixed connection with the drawing apparatus, properly speaking which, as is shown in the EP No. 0 074 421 A1 serves during the drawing for the counter-holding by the sheet metal holder. FIG. 1A shows this structure wherein the flange 1 abuts bottom tool 53, with a drawing punch 54 and sheet metal holder 55. The sheet metal holder 55 is supported by way of ejector pins 66 on a pressure plate 57 which is mounted to the upper end of piston rod 3 shown in FIG. 1. The various control valves are schematically shown connected to cam 63 via cam follower 64. A drawing ram 74 carries a drawing die 75 located in opposition to the sheet holder 55 and includes an upper ejector 76. The sheet metal stock is shown at 77. The pressure cylinder 2 is surrounded in its upper part by reservoir 4 for hydraulic liquid which is in fluid communication with a tank 5. The level in the reservoir 4 and in the tank 5 which drops, for example, owing to leakage losses is supplemented by way of a motor-pump-aggregate generally designated by reference numeral 35.

The pressure space 6 serves in conjunction with the pressure piston 10 for the controlled lift of the piston rod 3 for the ejection of the workpiece out of the work tool as is described in detail, for example, in the DE No. 35 05 984 A1. The lift control takes place by way of the pressure line 7 and the control block generally designated by reference numeral 8 whereas the refill of hydraulic liquid during the deformation takes place by way of the line 36 equipped with a check valve. Control 8 vents the chamber 6 when it is desired to raise piston rod 3, or alternatively chamber 12 is connected to high pressure when it is desired to lower the piston rod 3. A line for the return out of the lift control 8 into the reservoir 4 is designated by reference numeral 9. The line 11 serves for the venting.

The piston rod 3 extends with the downwardly extended part up to into a pressure space 12 and includes thereat a pressure piston 15. The mounted collar 14 is displaceable on the piston rod 3 together with the pressure piston 15 and serves for the lift-movement limitation of the piston rod 3. The pressure piston 15 forms an operating surface delimiting the pressure space 12 and adapted to be acted upon in the drawing direction 43. The pressure space 12 filled with hydraulic liquid is in fluid communication with a pressure quantity space 18 of a pre-acceleration cylinder 16. In addition to the housing, this cylinder includes a further pressure space 19 which is separated from the pressure quantity space 18 by the piston 17. For a deliberate pre-acceleration of the piston rod 3 in the drawing direction 43 during the pre-acceleration phase 41, which can be recognized in FIG. 2, the quantity of hydraulic liquid in the pressure quantity space 18 is adjustable to a predetermined quantity by way of, for example, automatically adjustable abutments or stops. The pressure space 19 opposite the pressure quantity space 18 is adapted to be brought into fluid communication with the pressure reservoir 22 by way of a pressure line 20 and a throttling directional control valve 21, for example, a so-called prop valve. The pressure in the pressure reservoir 22 is produced by way of a motor-pump-aggregate generally designated by reference numeral 24. The control of the throttling directional control valve 21 takes place from the press control by way of the control line 44 in dependence on the movement of the drawing ram. Filters, lubricating devices, water separators, pressure-receivers or accumulators, means for the pressure-reduction and -indication and the like are not shown in the schematic diagram because these means and the use thereof are generally known. The pressure in the pressure space 19 is adapted to be reduced into the pan 38 by way of the return line 37 and the return control generally designated by reference numeral 23 and more particularly during the upward movement (ejection of the workpiece) of the piston rod 3. The pressure piston 17 is rigidly connected with the piston of the return pressure cylinder 27 by way of its piston rod 28. During the upward movement of the piston rod 3, the required quantity in hydraulic liquid must be ready in the pressure quantity space 18 for the following pre-acceleration phase. The pressure piston 17 is to be completely retracted for that purpose and to that end, connection 44 from the ram travel cam follower 64 ensures that valve 21 is in its lower position closing off pressure source 22 and control return control 23 vents line 37 to pan 38. The control of the return-pressure cylinder 27 takes place by way of the return control 29 which is connected to the general control pressure line 26. When it is desired to pressurize chamber 12, control 29 is in its upper position applying high pressure to cylinder 27 which moves piston 17 to the left and empties chamber 18 into chamber 12. The pressure in the control line 26 is produced by way of the motor-pump-aggregate generally designated by reference numeral 25.

The pressure space 12 for the pre-acceleration is further connected with the reservoir 4 by way of a follow-up control with a valve 30 and a refill line 34. The valve seat 33 closes during the suction phase of the pressure space 12 when the piston 17 in the pre-acceleration cylinder 16 is displaced into its left position occupying the pressure quantity space 18, i.e., after the pre-acceleration phase 41 of the piston rod 3. In the upward movement phase of the piston rod 3, the valve seat 33 is to be opened whereby the pressure piston 17 has assumed its illustrated right position due to the action of control 29 moving downwardly and venting cylinder 17 and since valve 33 is caused to open, the pressure quantity space 18 is filled completely with hydraulic liquid. The control of the valve seat 33 into the open-position takes place by way of a control piston 32 adapted to be acted upon with control pressure from the common control pressure line 26. A 2/2 directional control valve 31 is provided for that purpose in the control pressure line 26 which is to be opened by way of a control line 45 coming from the press control via cam follower 64 in dependence on the position, respectively, movement phase of the drawing ram.

FIG. 2 illustrates in a diagram the curve 39 for a possible movement of the drawing ram as well as the curve 40 of the movement of the sheet metal holder. During the working stroke of the drawing ram, the sheet metal holder is pre-accelerated. With the termination of the pre-acceleration phase 41, the drawing ram contacts by means of the work tool upper part attached at the same on the sheet metal member which is being lowered. In the adjoining follow-up phase 42, hydraulic liquid is sucked-in into the pressure space 12 out of the reservoir 4 by way of the follow-up control 30.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A drawing installation for a press, comprising a mechanically actuated drawing ram means, a sheet metal holder means producing a holding force acting on a sheet metal member opposite a drawing direction by way of a pressure medium-actuated piston rod means in a fixed pressure cylinder means, the piston rod means being operatively connected with a pressure piton means having operating surface means acted upon in the drawing direction, said pressure cylinder means forming a pressure space around the operating surface means of the pressure piston means, control means operating in dependence on ram travel and operable to pre-accelerate the sheet metal holder means in the drawing direction by the piston pressure means prior to contact of the drawing ram means on the sheet metal holder means by connecting the operating surface means of the pressure piston means with hydraulic liquid, said control means including a pre-acceleration cylinder means having pressure quantity space means, a pressure space means and a pressure piston separating the pressure quantity space means from the pressure space means, a follow-up control means, hydraulic fluid reservoir, the pressure space of said pressure cylinder means being in hydraulic fluid-communication with the pressure quantity space means and being operable to be brought into hydraulic fluid communication with the reservoir of hydraulic fluid by a follow-up control means upon termination of the pre-acceleration of the sheet metal holder means by the pressure piston means.

2. A drawing installation according to claim 1, wherein there is a throttling directional valve means, and wherein the pressure space means of the pre-acceleration cylinder means is operable to be actuated with pressure by said control means operating in dependence on ram travel by way of the throttling directional valve means to lower the piston rod means and by a suction pressure to permit raising the piston rod means in response to ram travel.

3. A drawing installation according to claim 2, wherein said follow-up control means is operable to be activated by said control means.

4. A drawing installation according to claim 3, wherein there is a return pressure cylinder means having a piston and wherein the pressure piston means of the pre-acceleration cylinder means is operatively connected by way of its piston rod with a piston of the return pressure cylinder means.

5. A drawing installation according to claim 4, wherein the follow-up control means includes a directional control valve means which has a valve seat means that is opened to the pressure space of the pre-acceleration cylinder means in the presence of suction pressure in the pressure space and closes in the presence of high pressure space of the pre-acceleration cylinder means, a reservoir, the valve seat means opened to supply pressure for moving the piston rod means opposite the drawing direction by a directional control valve means that provides a hydraulic fluid connection between the pressure space of the pre-acceleration cylinder means and the reservoir.

6. A drawing installation according to claim 1, wherein there is a return pressure cylinder means having a piston and wherein the pressure piston means of the pre-acceleration cylinder means is operatively connected by way of its piston rod with the piston of a return pressure cylinder means.

7. A drawing installation according to claim 1, wherein the follow-up control means includes a directional control valve means which has a valve seat means that is opened to the pressure space of the pre-acceleration cylinder means in the presence of suction pressure in the pressure space and closes in the presence of high pressure in the pressure space of the pre-acceleration cylinder means, a reservoir, the valve seat means opened to supply pressure for moving the piston rod means opposite the drawing direction by a directional control valve means that provides a hydraulic fluid connection between the pressure space of the pre-acceleration cylinder means and the reservoir.

8. A drawing installation according to claim 1, wherein said follow-up control means is operable to be actuated by said control means.

* * * * *